US007387191B2

(12) United States Patent
Kostka et al.

(10) Patent No.: US 7,387,191 B2
(45) Date of Patent: Jun. 17, 2008

(54) METHOD AND APPARATUS FOR BYPASS CONTROL OF AN ELEVATOR INSTALLATION

(75) Inventors: Miroslav Kostka, Ballwil (CH); Kurt Steinmann, Rotkreuz (CH)

(73) Assignee: Inventio AG, Hergiswil NW (CH)

( * ) Notice: Subject to any disclaimer, the term of this patent is extended or adjusted under 35 U.S.C. 154(b) by 651 days.

(21) Appl. No.: 10/958,303

(22) Filed: Oct. 5, 2004

(65) Prior Publication Data

US 2005/0077114 A1 Apr. 14, 2005

(30) Foreign Application Priority Data

Oct. 10, 2003 (EP) ..... 03405729

(51) Int. Cl.
*B66B 1/16* (2006.01)

(52) U.S. Cl. ..... 187/381; 187/247

(58) Field of Classification Search ..... 187/380–389, 187/247

See application file for complete search history.

(56) References Cited

U.S. PATENT DOCUMENTS

| | | | | |
|---|---|---|---|---|
| 2,854,095 A | | 9/1958 | White | |
| 3,504,770 A | * | 4/1970 | Savino et al. | 187/383 |
| 3,610,342 A | | 10/1971 | Stainken | |
| 3,732,950 A | | 5/1973 | Savino | |
| 3,973,649 A | * | 8/1976 | Iwasaka et al. | 187/387 |
| 4,623,041 A | | 11/1986 | Hurbrügger | |
| 4,674,605 A | | 6/1987 | McPherson | |
| 4,708,224 A | | 11/1987 | Schrooder | |
| 5,004,076 A | | 4/1991 | Chen et al. | |
| 5,490,580 A | | 2/1996 | Powell et al. | |

FOREIGN PATENT DOCUMENTS

| | | |
|---|---|---|
| EP | 0 301 173 | 2/1989 |
| GB | 896 857 | 5/1962 |
| WO | WO 01/72621 | 10/2001 |
| WO | WO 03/026997 | 4/2003 |

* cited by examiner

*Primary Examiner*—Jonathan Salata
(74) *Attorney, Agent, or Firm*—Fraser Clemens Martin & Miller LLC; William J. Clemens

(57) ABSTRACT

A method of controlling an elevator installation having an elevator car transporting passengers between floors of a building inputs destinations of the passengers into a destination call control and books destination calls and determines an instantaneous load disposed in the elevator car with a load measuring device at a fixable point in time. In order to make uniform the waiting times of the passengers in the case of incorrect operation of the destination call control and to ensure, for all passengers, an optimized transport time with maximum transport capacity the method additionally compares the instantaneous load with a full load parameter and in the case of exceeding of the full load parameter activating a bypass function those floors for which destination calls are booked and which are passed during a half circuit of the fully loaded elevator car.

11 Claims, 2 Drawing Sheets

METHOD AND APPARATUS FOR BYPASS CONTROL OF AN ELEVATOR INSTALLATION

BACKGROUND OF THE INVENTION

The present invention relates to a method of controlling an elevator installation which comprises an elevator car transporting passengers between floors of a building. The method proposes that the travel wishes of the passengers are input by way of a destination call control and booked by the destination call control as destination calls. In addition, an instantaneous load disposed in the elevator car is determined by a load measuring device at a fixable point in time. The invention further relates to an elevator installation which is provided with an elevator car, a load measuring device determining an instantaneous load disposed in the elevator car and a destination call control by means of which travel wishes of passengers to be transported can be input and booked as destination calls.

In high buildings, particularly in so-termed skyscrapers, elevators are used which are controlled by a destination call control. In that case the travel destination must be input by way of a numerical keyboard or another form of input means by every passenger before the start of travel. The control of the elevator installation notifies the passenger, on the basis of his or her travel destination input, an elevator which guarantees for the passenger an optimized travel time. An elevator installation with destination call control is described in, for example, the published application WO 01/72621 A1. The basis for functioning of an elevator installation based on a destination call control is a disciplined input of destination calls.

However, a disciplined behavior of that kind of the passengers cannot always be presupposed. Situations can arise that only one person of a group undertakes a destination call input or it can happen that one person puts in several destination call inputs for a group, wherein, however, the number of persons does not correspond with the number of destination call inputs. This undisciplined input of destination calls in which the destination call control is not correctly operated frequently occurs when many persons have to be transported at the same time from a floor to, for example, the ground floor, wherein the bulk of passengers know that all elevators travel in the direction of the ground floor. An undisciplined input of destination calls can accordingly be regularly established when fixed working times exist and many office workers of a company leave their office spaces at almost the same time in order to travel to the ground floor. The elevator cars are thereby usually fully laden already in the upper floors without every passenger having individually booked his or her travel destination by means of the destination call input. The destination call control undertaking allocation of the elevators proceeds only from the booked destination calls.

The problem therefore results that destination call inputs of passengers in the floors lying further down are allocated to elevator cars which are fully loaded, so that these passengers cannot be transported by the allocated elevator car. However, notwithstanding the full load the elevator car stops at every floor at which a destination call input was registered and a destination call allocated to the corresponding elevator car. This can lead to the situation that a passenger who would like to disembark at a floor above the ground floor is allocated an already fully loaded elevator car. The elevator car then stops at the floor at which the passenger proposes to board, but the passenger cannot since the elevator car is full. The elevator car consequently also stops at the floor at which the passenger wanted to disembark, although nobody does disembark.

Due to the undisciplined inputs of destination calls substantial increases in transport times arise and ultimately this leads to a reduction in transport capacity, which leads to very long waiting times particularly in buildings with an otherwise small transport capacity.

A group control for elevators is described in European patent document EP 0 301 173 A1 which has a monitoring circuit preventing allocation of a destination call to an elevator with an overload. However, the starting point is a careful input of destination calls, since the overload is determined on the basis of booked passengers.

In PCT published application WO 03/026997 A1 there is described an elevator installation in which the elevator load is measured by continuous load measuring so that the number of passengers who have not input a destination call input can be determined.

SUMMARY OF THE INVENTION

The present invention has the object of avoiding the above-mentioned problems with incorrect operation of the destination call control and of indicating a method for controlling an elevator installation, and an elevator installation, by which the transport time can be optimized and transport capacity maximized.

According to the present invention this object is fulfilled in the case of a method of controlling an elevator installation with the above-mentioned features in that the instantaneous load is compared with a full load parameter and a bypass function is activated when the full load parameter is exceeded. The bypass function is in that case activated for such floors for which destination calls are booked and are still passed during a half circuit of the elevator car. By 'half circuit' in the sense of the present invention there is to be understood a travel of the elevator car between the points of reversal of the elevator car.

The present invention is based on the concept that peak times, which in the case of a predominating downward travel are also termed "down peak traffic", occur only at specific times. With the method according to the present invention uniform waiting times and an optimized utilization of the transport capacity are achieved in these peak times even in the case of possibly incorrect operation of the destination call control. It is ensured by means of the bypass function that a fully laden elevator car travels directly to the next disembarkation destination and destination call inputs of passengers waiting in the intermediate floors are shifted to a next elevator half circuit.

In an advantageous embodiment of the present invention the elevator car, when the bypass function is activated, is not moved to the floors for which destination calls booked by the destination call control are present and at which passengers of the half circuit would like to board until the instantaneous load again lies below the full load parameter. It is thereby achieved that a fully laden elevator car travels on a direct path from the higher floors to the ground floor or to a main stopping floor without having to stop at already booked floors and thus wasting transport time.

In a further advantageous embodiment of the present invention it is provided that destination calls which were booked before exceeding of the full load parameter occurred and which were not served on the half circuit are shifted to a priority half circuit with the same travel direction, wherein preferably the priority half circuit is covered by the elevator car subsequently to the first half circuit. It is thereby achieved that after arrival of the fully laden elevator car at the ground floor or at the main stopping floor the elevator car travels on a direct path to the upper floors and collects the passengers who were already allocated this elevator and could not be transported in the first downward half circuit due to the fully laden elevator car.

In an advantageous embodiment of the present invention the floor at which exceeding of the full load parameter has occurred is moved to again by the elevator car only when all destination calls, which were booked before exceeding of the full load parameter occurred and which were not served on a first half circuit and/or following priority half circuits, are served. It is thereby avoided that the elevator in its upward half circuit travels back to the floor at which not all passengers have input their travel destinations and the elevator car was fully laden without the passengers having been already booked. A repetition of the situation of the first downward half circuit is thus avoided.

In a further advantageous embodiment of the present invention it is provided that the elevator after serving all destination calls booked before exceeding of the full load parameter occurred is set to a normal mode (operation without bypass function). It is thus achieved that only after all passengers, who have not been transported, are transferred to the ground floor or to the main stopping floor from the floors which were not moved to due to the bypass function, can newly input destination calls again be allocated to the elevator by the destination call control.

Measurement of the instantaneous load is advantageously undertaken at the instant of door closing. It is thus achieved that a change in the load of the elevator can no longer take place, so that no errors can arise in the comparison of the instantaneous load of the elevator car with the full load parameter.

In a further advantageous embodiment of the present invention a number of free places is calculated from the disembarking and embarking passengers booked per the destination call control, wherein the elevator car moves to a floor only when the number of free places is greater than the number of destination calls of boarding passengers in the floors to be passed in the half circuit. Through this embodiment it is made possible for free places, which arise in the elevator car due to disembarking passengers before the main stop, can be occupied notwithstanding the bypass function being switched on. Through calculation of the number of free places it is made possible for the elevator to stop in the case of that kind only when the number of free places is sufficient to be able to accept all passengers waiting at a floor. Unnecessary stops are thus avoided. A floor lying between the ground floor and the floor at which exceeding of the full load parameter has occurred counts as not moved to when at least one destination call of a passenger at this floor was not served. Floors which the elevator car has moved past without stopping count as not moved to. Thereagainst, floors which were moved to, notwithstanding the activated bypass function, since passengers have disembarked, count as moved to when all passengers have been transported from this floor.

In a further advantageous embodiment of the present invention there is provided a counter which counts the starts of journeys of the elevator car in which the instantaneous load is greater than the full load parameter. The bypass function is activated, in an embodiment of that kind, only when a predetermined settable value for the maximum number of full load trips of that kind is exceeded. Through an embodiment of that kind it is made possible that a solitary incorrect operation of the destination call control does not immediately lead to activation of the bypass function, so that travel movements, which are incomprehensible for passengers, of the elevator car are suppressed.

In this connection it is advantageously provided that with each start of the elevator car with a smaller instantaneous load than the full load parameter the value of the counter decremented. Thus, activation of the bypass function is avoided when it is not absolutely necessary, for example when a fully laden elevator car has occurred only by chance and not within predetermined time periods or in typical situations. In addition, activation of the bypass function can advantageously be monitored by a time period, wherein the time period is used in common with the value of the counter for activation and/or deactivation of the bypass function. For this purpose the time period is set to, for example, 5 minutes and the value of the counter for activation of the bypass function is periodically decremented, for example, every 2 minutes. The bypass function is deactivated only when not only the time period of 5 minutes has expired, but also the value of the counter lies below a value for activation of the bypass function due to the periodic decrementing and a priority half circuit no longer exists.

In an advantageous embodiment of the present invention it is provided that activation of the bypass function is undertaken in the case of a counter value which is greater than the value for deactivation of the bypass function. In this manner there is achieved a hysteresis function avoiding an unnecessary switching back and forth between activated and deactivated bypass function.

In a further advantageous embodiment of the present invention the elevator installation comprises a group of elevators, wherein the bypass function can be separately activated for each elevator of an elevator group so that the priority half circuits, which are to be inserted, for transporting the non-transported passengers to the floors which have not been moved to can be covered or served solely by the elevator concerned. In an alternative embodiment the bypass function is activated in common for all elevators belonging to a group, wherein only a part of the elevators is used for serving the floors, which have not been moved to, with the waiting passengers during the priority half circuits. The other elevators belonging to this group can consequently already operate again in normal mode or they can further operate in bypass function in that the floor at which the overload has occurred is preferentially served.

In a further advantageous embodiment of the present invention all input destination calls are assigned to the first downward priority half circuit in the case of activation of the bypass function and an upward travel direction. This is required particularly when, with activated bypass function, the elevator car is disposed at the ground floor or at the main stopping floor and its next travel direction is the upward travel direction. Accordingly, it is ensured in this case that the passengers left standing at the floors, which are not moved to, in the case of the upward travel direction are moved to in the case of the following downward priority half circuit and their destination calls are served.

In a further advantageous embodiment of the present invention in the case of activation of the bypass function and a downward travel direction all input destination calls below the elevator car position in the first downward priority half circuit are served and all destination calls input above the elevator car position are served in the next following downward priority half circuit. It is thereby made possible that in the case of activated bypass function and a position of the elevator car within the upper floors the destination calls below the elevator car position are served in the first downward priority half circuit and the destination call lying above the floor in which the overload has occurred are served in the next following downward priority half circuit.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
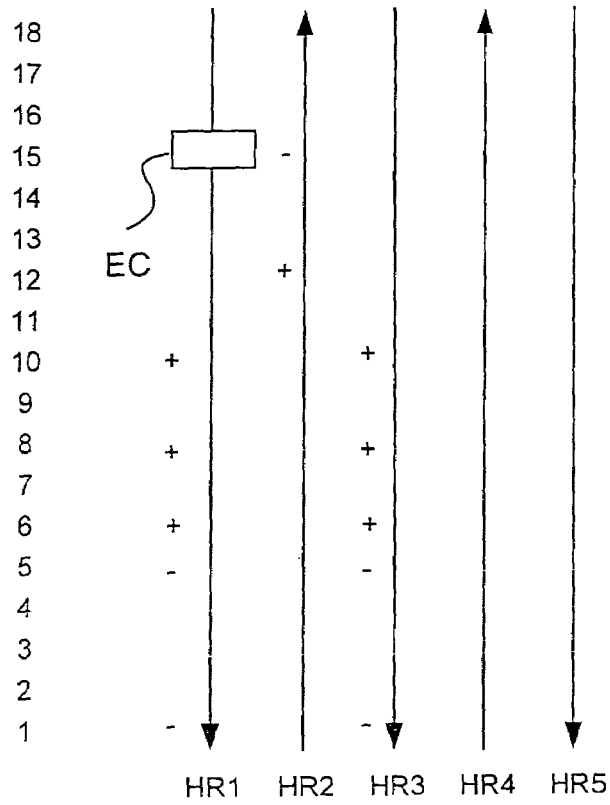
FIG. 1 Prior Art
FIG. 1 is a schematic diagram showing a case of incorrect operation of a destination call control according to a prior art elevator installation.

The problem of an incorrect operation of the destination call control is schematically illustrated in FIG. 1. FIG. 1 symbolizes 18 floors of a building. In addition, half circuits HR1 to HR5 are illustrated by arrows. An elevator car EC is disposed at floor 15. The following situation can be presented in order to explain the problem.

A normal public traffic prevails in the building, but at the same time a conference ends at floor 10. Virtually all conference participants would like to travel to the main stop at floor 1, but only a few actuate the terminal for the destination call input. This has the consequence that the destination call control is falsely informed about the number of persons who are waiting and assigns destination calls of embarking persons below the floor 10 to the elevator.

This is explained in the following by way of a numerical example. In this case the elevator car size or capacity is 15 persons. At floor 10, 7 persons who have the destination floor 1 are allocated by the destination call control. This means only 7 participants of the conference have input a destination call. At floor 8, 2 persons who have the travel destination of floor 5 are allocated. At floor 6, 1 person who has the destination of floor 1 is allocated and, at floor 12, 3 persons who would like to travel to floor 15 are allocated. The journeys of the elevator car EC are planned in the so-termed half circuits HR1, HR2, HR3, HR4 and HR5. In that case a half circuit "HRx" represents a journey in one direction between two points of reversal, wherein intermediate stops are also included. The floors at which at least one boarding passenger is allocated are denoted by a plus "+". The floors at which 1 passenger would like to disembark are characterized by a minus "−". If 15 passengers board at floor 10 instead of the 7 reported passengers, the elevator car EC is fully occupied and can no longer pick up any passengers at floors 8 and 6 during the downward half circuit HR1. However, the elevator car EC nevertheless stops at the floors 8 and 6. At floor 5 the elevator car EC also stops for the destination of the booked boarding passenger from floor 8, who does not find any space in the elevator car EC since the elevator car EC was already fully occupied at floor 8.

Subsequently to the half circuit HR2 upwardly to the floors 12 and 15, further passengers board at floor 10 in the downward half circuit HR3. Even when the passengers continuing to wait at floors 8 and 6 put in their destination call once again and these are noted in the half circuit HR3, the elevator car EC could again be filled at floor 10 in such a manner that it is fully occupied so that the situation for the passengers at floors 8 and 6 would be repeated.

Figure 2:
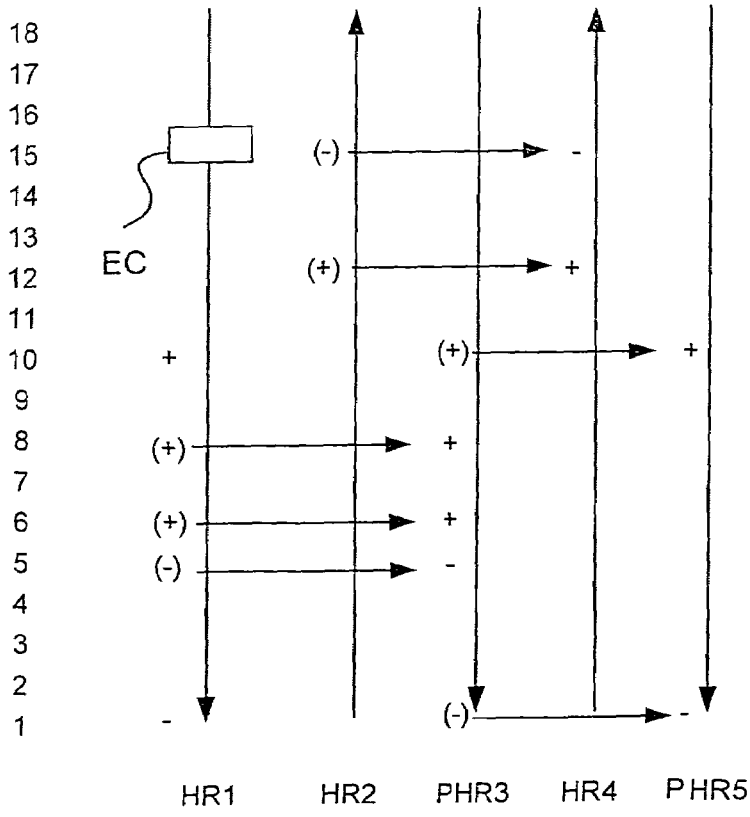
FIG. 2 is a schematic diagram showing the bypass function operation of an elevator installation according to the present invention.

FIG. 2 schematically shows the method according to the present invention. Again, 18 floors are illustrated and the elevator car EC is disposed at the floor 15. The number of passengers is as in the example previously explained on the basis of FIG. 1. The bypass function is already activated during the first half circuit HR1 as soon as the full load of the elevator car EC is recognized by a load measuring device measuring the instantaneous load of the elevator car EC and the function displaces the destination calls of the passengers to the floors 8 and 6 to the next priority half circuit PHR3 and the upward call of floor 12 to floor 15 from the half circuit HR2 to the half circuit HR4. In addition, all newly input destination calls, for example at floor 10, are correspondingly shifted to the half circuits HR4, PHR5 after the priority half circuit PHR3. Thus, the elevator car EC travels, subsequently to unloading the passengers at the floor 1, upwardly to the floors 8, 6, 5 in order to transport passengers who were not transported in the first half circuit HR1 due to the bypass function. The passengers at floor 12 are transported in the next upward half circuit HR4 to floor 15. Only after all forgotten passengers have been transported are later input destination calls from the floor 10 taken into consideration. In the allocation of new destination calls possibly further elevators of the elevator installation will help to relieve the situation.

The activation of the bypass function can also be activated, apart from in the above-described situation, in dependence on further circumstances. Thus, unnecessary activations of the bypass function as a result of only random erroneous inputs of the destination call control are avoided. In order to make this possible there is provided a counter which counts the starts of the elevator car, in which the full load is exceeded, by a value CFLDP. Thereafter, the bypass function is only activated when, for example, the full load was exceeded three times (CFLDP=3) in successive half circuits HR. If the full load is not exceeded in a half circuit HR, then the value CFLDP is decremented again. The necessity of activation of the bypass function is thus defined more precisely.

The deactivation of the bypass function can also be undertaken in a time-controlled manner. For that purpose there are used a time period TDP and the value 10 CFLDP. The time period TDP begins to run after the first exceeding of the full load parameter. It can also be provided that the time period TDP begins to run only after the first start in which the instantaneous load of the elevator car EC is smaller than full load. However, the bypass function is deactivated only when, in addition to the value CFLDP, a predetermined value DPOFF was reached. In this example the value CFLDP of the counter is periodically decremented.

In order to avoid unnecessary switching to and fro between activation and deactivation of the bypass function a hysteresis can be implemented in the values DPON and DPOFF for activation or deactivation of the bypass function.

The afore-described method of controlling an elevator installation is distinguished by a tolerance with respect to incorrect operation in the destination call control. It is principally attributable to the bypass function which prevents a fully laden elevator car stopping, during a half circuit HR, at floors 8, 6, 5 for which destination calls are indeed booked, but at which no passengers can board due to the loading of the elevator car EC. The method thus contributes to an optimized utilization of the transport capacity of the elevator car EC and additionally guarantees swift transport of passengers.

Figure 3:
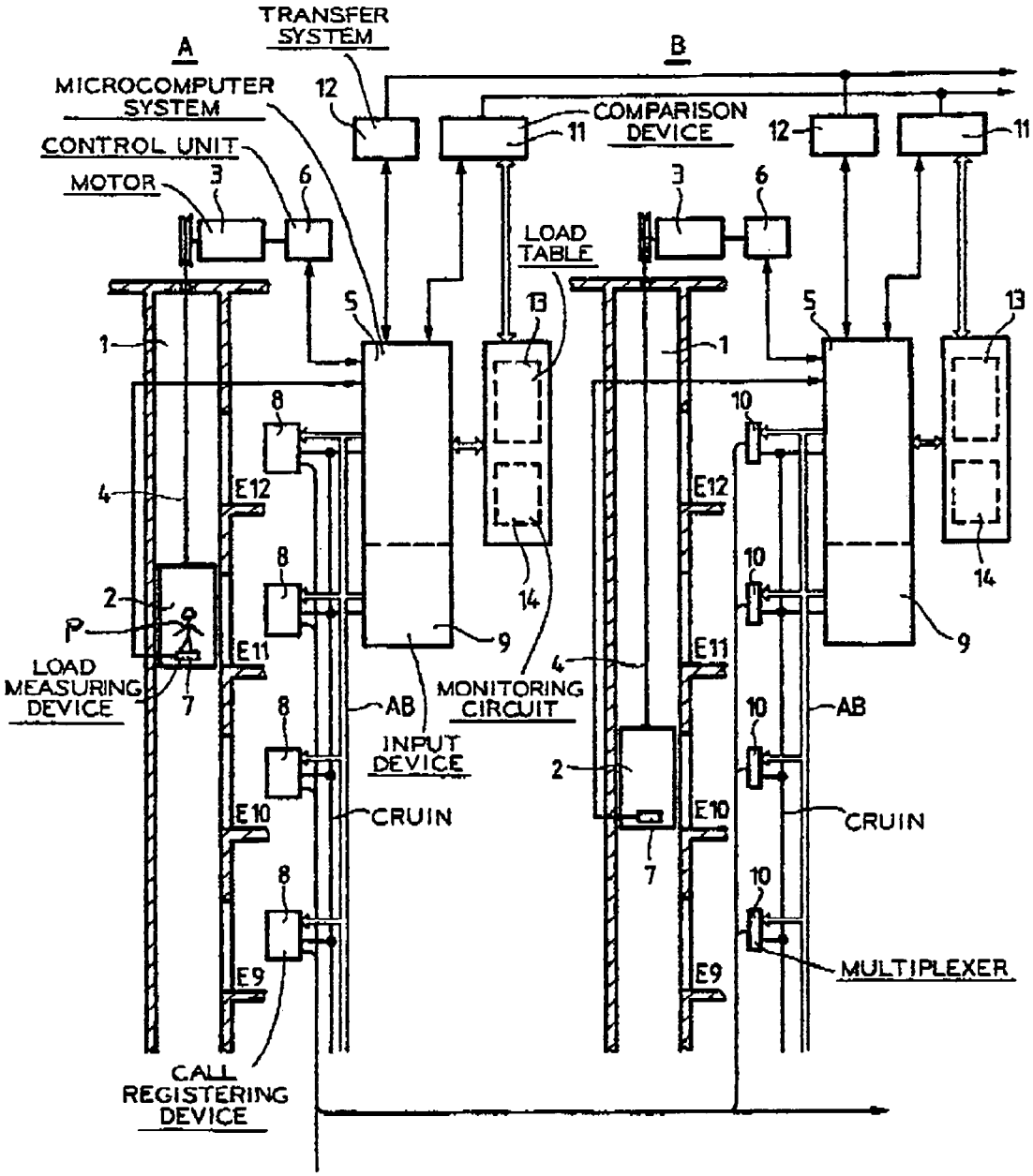
FIG. 3 is a schematic diagram of an elevator system for performing the bypass function according to the present invention.

Designated with A and B in FIG. 3 are two elevators of an elevator group, each having an elevator car 2 guided in an elevator shaft 1 and driven by a hoist motor 3 by way of a hoisting cable 4. Each elevator car 2 serves, for example, thirteen floors E0 to E12 with only the top four floors being shown. The hoist motor 3 is controlled by a control system, such as is shown in the European patent no. EP-B 0 026 406, where the generation of the nominal or set point values, the control functions and the stop initiation are realized by means of a microcomputer system 5, which is connected with a control unit 6 of the drive control system. The car 2 includes a load measuring device 7, which is likewise connected with the microcomputer system 5, for determining when passengers P enter and leave the elevator car.

Provided at the floors are call registering devices 8 in the form of ten key keyboards, by means of which floor calls for trips to desired floors of destination can be entered. The call registering devices 8 are connected with the microcomputer system 5 and an input device 9, shown in the European patent no. EP-B 0 062 141, by way of an address bus AB and a data input conductor CRUIN. The call registering devices 8 can be assigned to more than one elevator group. For example, those of the elevator A are in connection by way of coupling elements in the form of multiplexers 10 with the microcomputer system 5 and the input device 9 of the elevator B. The microcomputer systems 5 of the individual elevators of the group are connected together by way of a comparison device 11, shown in the European patent no. EP-B 0 050 304, and by way of a party-line transfer system 12, shown in the European patent no. EP-B 0 050 305, and form, together with the call registering devices 8 and the input devices 9, a group control, which structurally conforms to the group control described in the European patent application no. EP-A 0 246 395. Designated with 13 is a load table and with 14 is a monitoring circuit, which are connected to each other and with components of the microcomputer system 5.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of controlling an elevator installation having an elevator car transporting passengers between floors of a building, comprising the steps of:

a) inputting travel destinations of passengers into a destination call control and booking destination calls;

b) determining an instantaneous load disposed in the elevator car with a load measuring device at a fixable point in time; and c) comparing the instantaneous load with a full load parameter and in the case of exceeding the full load parameter activating a bypass function, wherein the bypass function is activated for those floors for which destination calls are booked which are then passed during a half circuit journey of the elevator car and wherein the bypass function shifts the destination calls not served on the half circuit journey and booked before exceeding the full load parameter to a priority half circuit journey with the same direction of travel.

2. The method according to claim 1 wherein when the bypass function is activated, movement by the elevator car to the floors for which destination calls are booked and which are passed during the half circuit of the elevator car is suppressed until the instantaneous load again lies below the full load parameter.

3. The method according to claim 1 wherein destination calls which were booked before exceeding of the full load parameter occurred and which were not served on the half circuit due to the activated bypass function are shifted to a priority half circuit with the same direction of travel, wherein preferably the priority half circuit is covered byte elevator car in the journey following the half circuit in the same direction of travel.

4. The method according to claim 1 wherein the floor at which exceeding of the full load parameter has occurred is moved to again by the elevator car only when all destination calls which were booked before exceeding of the full load parameter occurred and which were not served on a first half circuit and/or following priority half circuits are served.

5. The method according to claim 1 wherein a number of free places in the elevator car is calculated from the disembarking and embarking passengers booked by the destination call control, and wherein the elevator car moves to a floor when the number of free places is greater than the number of destination calls of boarding passengers at the floors to be passed in the half circuit.

6. The method according to claims 1 wherein a counter counts the starts of trips of the elevator car in which the instantaneous load is greater than the full load parameter, and wherein in the case of exceeding a predetermined value of such starts for activation of the bypass function the bypass function is activated.

7. The method according to claim 6 wherein the count of the counter is decremented for each start of the elevator car with a smaller instantaneous load than the full load parameter.

8. The method according to claim 6 wherein after activation of the bypass function a time period is monitored and the count of the counter is periodically decremented, and wherein the bypass function is deactivated only when the time period has expired and the count of the counter lies below the predetermined value for activation of the bypass function.

9. An elevator installation with an elevator car, a load measuring device determining an instantaneous load disposed in the elevator car and a destination call control by which travel destinations of passengers to be transported can be input and booked as destination calls, comprising:

means for comparing the instantaneous load with a full load parameter and when the full load parameter is exceeded activating a bypass function for the destination call control for those floors for which destination calls are booked and which are passed during a half circuit journey of the elevator car and wherein the bypass function shifts the destination calls not served on the half circuit journey and booked before exceeding the full load parameter to a priority half circuit journey with the same direction of travel.

10. The elevator installation according to claim 9 including a counter which with each start of the elevator car with an instantaneous load greater than the full load parameter increments a count for activation of the bypass function and the bypass function is activated on attainment of a predetermined maximum value of the count wherein the counter decrements the count for activation of the bypass function with each journey of the elevator car with an instantaneous load smaller than the full load parameter.

11. A method of controlling an elevator installation having an elevator car transporting passengers between floors of a building, comprising the steps of:

a) inputting travel destinations of passengers into a destination call control and booking destination calls;

b) determining an instantaneous load disposed in the elevator car with a load measuring device at a fixable paint in time;

c) comparing the instantaneous load with a full load parameter and in the case of exceeding the full load parameter activating a bypass function, wherein the bypass function is activated for those floors for which destination calls are booked which are then passed during a half circuit journey of the elevator car; and d) counting with a counter the starts of trips of the elevator car in which the instantaneous load is greater than the full load parameter, and wherein in the case of exceeding a predetermined value of such starts for activation of the bypass function the bypass function is activated.

* * * * *